US006591503B1

(12) United States Patent
Voves

(10) Patent No.: US 6,591,503 B1
(45) Date of Patent: Jul. 15, 2003

(54) PIZZA CUTTING AND EATING TOOL

(75) Inventor: Mark A. Voves, Cresco, IA (US)

(73) Assignee: Marway Industries, LLC, Cresco, IA (US)

( * ) Notice: Subject to any disclaimer, the term of this patent is extended or adjusted under 35 U.S.C. 154(b) by 7 days.

(21) Appl. No.: 10/072,371

(22) Filed: Feb. 7, 2002

(51) Int. Cl.[7] ..... B25F 1/00; B25F 3/00
(52) U.S. Cl. ..... 30/142; 30/319; 30/322
(58) Field of Search ..... 30/307, 309, 142, 30/322, 323

(56) References Cited

U.S. PATENT DOCUMENTS 3,711,945 A * 1/1973 Cronheim ..... 30/142
4,423,551 A * 1/1984 Chmela et al. ..... 30/142
D286,608 S * 11/1986 Leung ..... D7/688
5,428,898 A * 7/1995 Hawkins ..... 30/295
5,469,622 A * 11/1995 Gradoni ..... 30/146
5,555,625 A * 9/1996 Scheminger ..... 30/319
D393,987 S * 5/1998 Molo ..... D7/694
D425,376 S * 5/2000 Voves ..... D7/643
6,484,407 B2 * 11/2002 Khatchadourian et al. .... 30/319

* cited by examiner

*Primary Examiner*—Alian N. Shoap
*Assistant Examiner*—Ghassem Alie

(57) ABSTRACT

A pizza cutter and eating tool has a fork portion, an elongated handle connected to a rearward end of the fork portion. A cutting wheel mounting area is located in the handle adjacent the rearward end of the fork portion. An elongated longitudinal slot is located in the mounting area. Cutting wheel mounting tabs have upper ends secured to a center portion of the slot and they extend downwardly therefrom below the fork. A pizza cutting tool is rotatably mounted on the mounting tabs and an upward periphery of the wheel extends partially through the elongated slot. An arcuate elongated guard member extends from a forward end of the slot, thence upwardly and over a portion of a periphery of the cutting wheel, and thence extends downwardly through a rearward end of the elongated slot, and thence outwardly and rearwardly from an adjacent portion of the periphery of the cutting wheel below the elongated slot.

1 Claim, 3 Drawing Sheets

PIZZA CUTTING AND EATING TOOL

BACKGROUND OF THE INVENTION

This is an improvement over the pizza cutting and eating tool of U.S. Pat. No. Des. 425,376. That patent shows a fork device with a pizza cutting wheel mounted on the lower side thereof immediately and rearwardly adjacent the tongs of the fork. An arcuate guard member extends over the upper periphery of the cutting wheel as it projects through a slot in the fork.

The device of the above design patent failed to provide protection to the hands and the finger of the user from possible injury to the rotating wheel at a position beneath the fork. In addition, the design patent failed to disclose a convenient, economical, and efficient way of mounting the wheel guard on the fork.

It is therefore a principal object of this invention to provide a pizza cutting and eating tool which is completely safe to use by the user, and which can be economically and efficiently manufactured. These and other objects will be apparent to those skilled in the art.

SUMMARY OF THE INVENTION

A pizza cutter and eating tool has a fork portion, an elongated handle connected to a rearward end of the fork portion. A cutting wheel mounting area is located in the handle adjacent the rearward end of the fork portion. An elongated longitudinal slot is located in the mounting area.

Cutting wheel mounting tabs have upper ends secured to a center portion of the slot and they extend downwardly therefrom below the fork. A pizza cutting tool is rotatably mounted on the mounting tabs and an upward periphery of the wheel extends partially through the elongated slot.

An arcuate elongated guard member extends from a forward end of the slot, thence upwardly and over a portion of a periphery of the cutting wheel, and thence extends downwardly through a rearward end of the elongated slot, and thence outwardly and rearwardly from an adjacent portion of the periphery of the cutting wheel below the elongated slot.

DESCRIPTION OF THE PREFERRED EMBODIMENT

Figure 3:
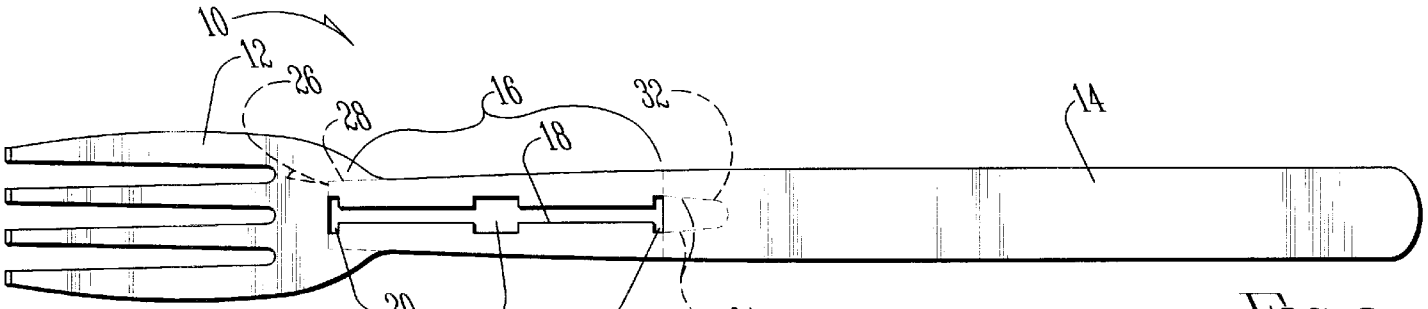
FIG. 3 is an enlarged scale plan view of the fork and handle portion.
Figure 4:
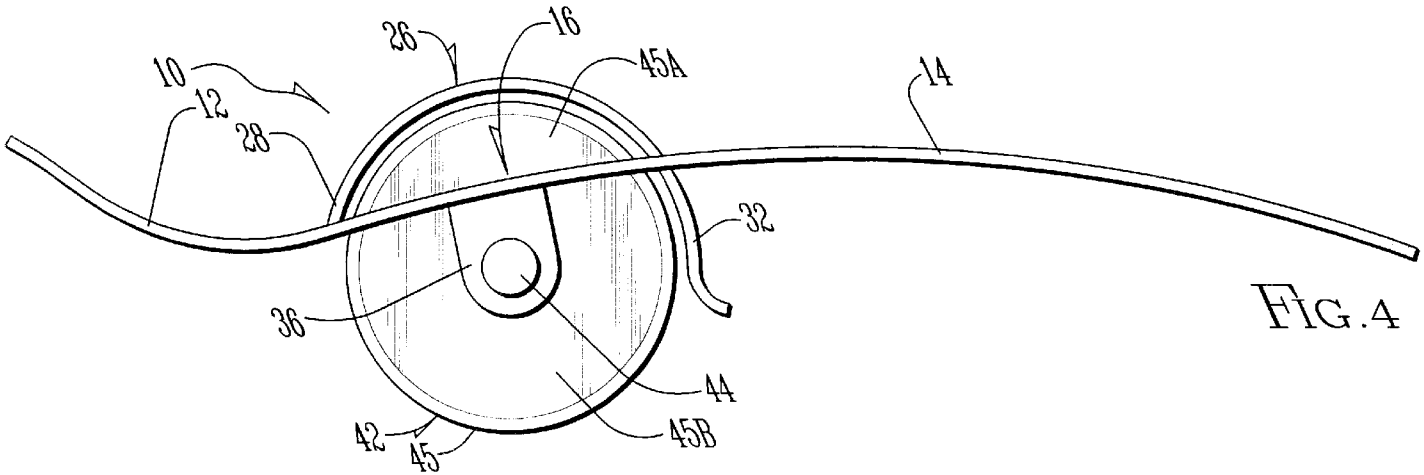
FIG. 4 is a side elevational view of FIG. 1.

A pizza cutting and eating tool 10 has a fork portion 12 on the forward end of a handle portion 14. As seen in FIG. 4, the fork portion 12 is slightly arcuate as seen from the side, and extends upwardly and outwardly, while the handle portion 14 has its rearward portion curved slightly downwardly, thus assuming a configuration similar to a conventional fork. A cutting wheel mounting area 16 (FIG. 3) is substantially flat or planar and is located on the handle portion 14 immediately rearward of the fork portion 12. An elongated longitudinal slot 18 is located in the mounting area. Slot 18 has a forward transfer slot 20 at its forward end, and a rearward transfer slot 22 at its rearward end. A widened notch portion 24 is located substantially in the center of slot 18 and has a width wider than the slot 18 and substantially equal to the transfer slots 20 and 22.

Figure 1:
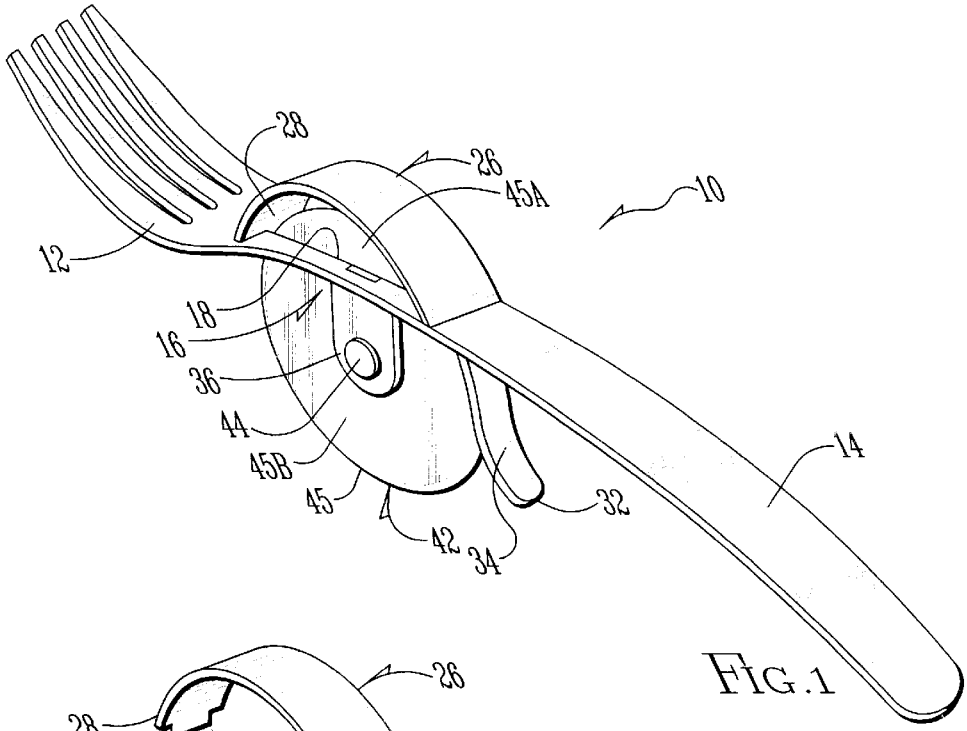
FIG. 1 is a perspective view of a pizza cutting and eating tool.
Figure 2:
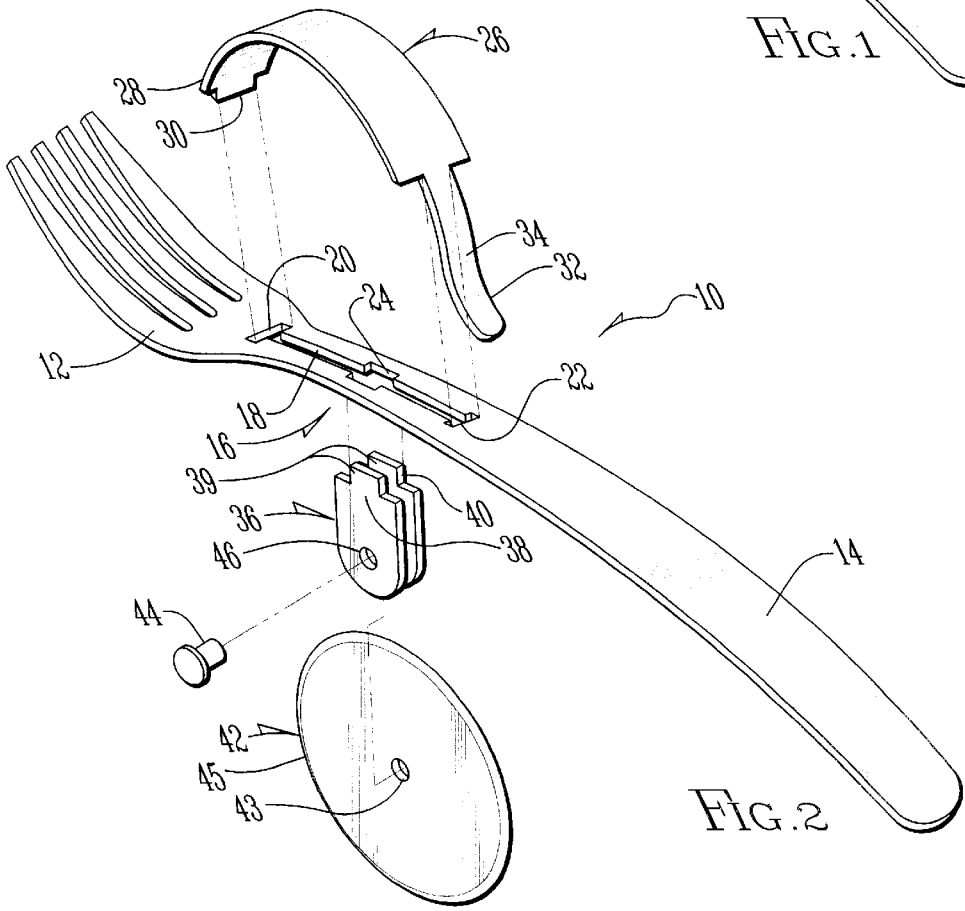
FIG. 2 is an exploded perspective view of FIG. 1.
Figure 5:
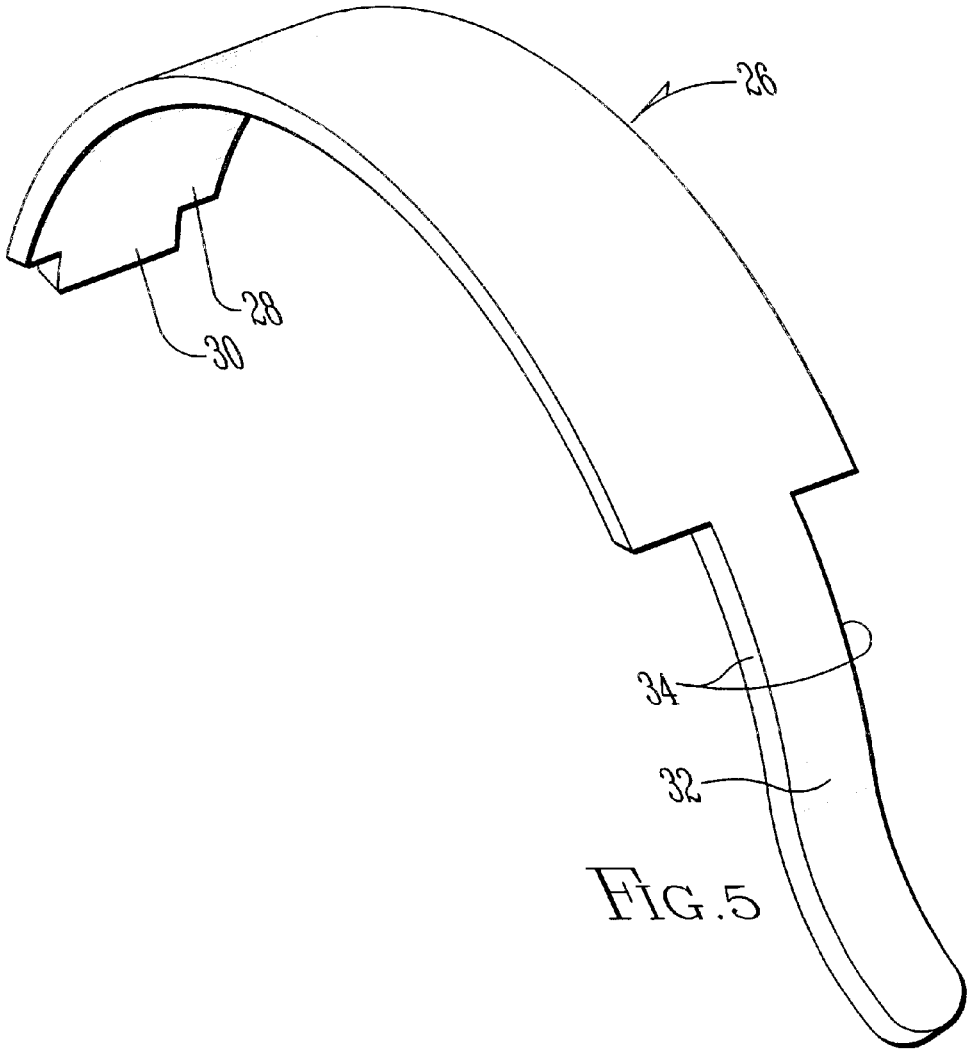
FIG. 5 is a perspective view of the blade guard element.
Figure 6:
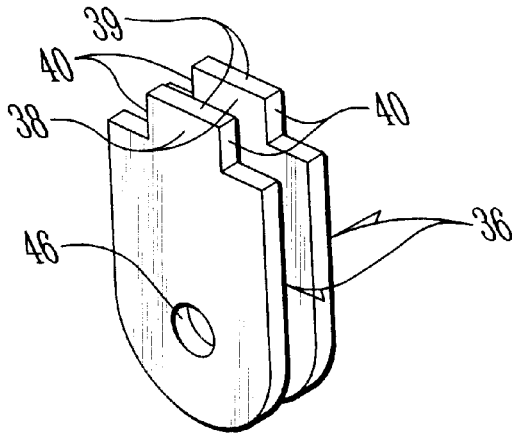
FIG. 6 is a perspective view of a cutting wheel mounting tab.

An arcuate cutting guard member 26 has a forward end 28 (FIGS. 2 and 5). The forward end 28 is notched at 30 to fit into the forward transfer slot 20. The rearward end 32 of guard member 26 extends downwardly through the rearward transfer slot 22 and is curved outwardly and rearwardly from the cutting wheel to be discussed hereafter. The width of guard member 26 at location 34 is complimentary in size to the length of the rearward transfer slot 22.

Cutting wheel tabs 36 have an aperture 35A and upper ends 38 which are notched at 39 to be complimentary in length to the sides 40 of the notched portion 24. The tabs are welded in notch portion 24 in spaced apart parallel relation. A cutting wheel is rotatably mounted between the wheel tabs 36 by means of a center aperture 36A in the wheel which receives mounting rivet 44 which also extends through apertures 36 and the cutting wheel tabs.

In assembly, the cutting wheel 42 is rotatably mounted between tabs 36 by means of mounting rivet 44 in the manner described. It should be noted that cutting wheel 42 has a periphery 45 with a periphery portion 45A dwelling above the handle portion 12, and a periphery portion 45B dwelling below the handle portion. (FIG. 4). The rearward end 32 of the guard member 26 is inserted through the rearward transfer slot 22. The guard member is then lowered over the upper periphery 45A of cutting wheel 42. The guard member 26 is then welded to the forward and rearward ends of elongated slot 18.

Because the rearward end 32 of the guard member 26 is curved outwardly and rearwardly of the periphery 45B of the cutting wheel below the handle, the fingers of the operator are well protected from the cutting wheel as they extend below the handle portion 14.

It is therefore seen that this invention encompasses a safe pizza cutting and eating tool which can be efficiently and economically fabricated and assembled.

I claim:

1. A pizza cutter and eating tool, comprising, a fork portion, an elongated handle connected to a rearward end of the fork portion, a cutting wheel mounting area in the handle adjacent the rearward end of the fork portion, an elongated longitudinal slot in the mounting area, wheel mounting tabs having upper ends secured to a center portion of the slot and extending downwardly therefrom, a pizza cutting wheel rotatably mounted on the mounting tabs, and extending partially upwardly through the elongated slot, an arcuate elongated guard member extending from a forward end of the elongated slot, thence upwardly and over a portion of a periphery of the cutting wheel, and thence extends downwardly through a rearward end of the elongated slot, and thence outwardly and rearwardly from an adjacent portion of the periphery of the cutting wheel below the elongated slot.

* * * * *